US011264763B1

(12) United States Patent
Su et al.

(10) Patent No.: US 11,264,763 B1
(45) Date of Patent: Mar. 1, 2022

(54) CONNECTOR WITH DIRECT LOCKING AND ROTATIONAL PRE-EJECTION FUNCTION

(71) Applicant: NEXTRONICS ENGINEERING CORP., New Taipei (TW)

(72) Inventors: Hou-An Su, Keelung (TW); Yong Zhang, Guangzhou (CN); Can-Hui Liang, Guangzhou (CN); Yu-Ting Sun, Keelung (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 37 days.

(21) Appl. No.: 17/035,713

(22) Filed: Sep. 29, 2020

(30) Foreign Application Priority Data

Aug. 11, 2020 (CN) ..... 202010800367.7

(51) Int. Cl.
*H01R 13/633* (2006.01)
*H01R 13/627* (2006.01)

(52) U.S. Cl.
CPC ..... *H01R 13/633* (2013.01); *H01R 13/6275* (2013.01)

(58) Field of Classification Search
CPC ..... H01R 13/622; H01R 13/6275; H01R 13/633; H01R 13/635
See application file for complete search history.

(56) References Cited

U.S. PATENT DOCUMENTS 11,196,218 B1 * 12/2021 Su ..... H01R 13/639
2010/0136817 A1 * 6/2010 Schulze ..... H01R 13/622 439/339
2016/0006171 A1 * 1/2016 Yu ..... H01R 13/622 439/300

* cited by examiner

*Primary Examiner* — Oscar C Jimenez
(74) *Attorney, Agent, or Firm* — Li & Cai Intellectual Property Office

(57) ABSTRACT

A connector with a direct locking and a rotational pre-ejection function is provided. The connector includes an insulated body, a plurality of terminals, an inner shell, an outer shell, a snap ring, a plurality of fasteners, an ejector, a first elastic element, and a second elastic element. The outer shell has a cam surface, the ejector has an abutting portion, and the abutting portion is in contact with the cam surface. When the connector and a mating connector are inserted into each other, snap bodies of the fasteners and fastener bodies of the mating connector can be snapped into each other to be directly locked. When the connector and the mating connector are to be separated from each other, the snap bodies of the fasteners and the fastener bodies of the mating connector can be separated from each other to be directly unlocked.

12 Claims, 9 Drawing Sheets

CONNECTOR WITH DIRECT LOCKING AND ROTATIONAL PRE-EJECTION FUNCTION

CROSS-REFERENCE TO RELATED PATENT APPLICATION

This application claims the benefit of priority to China Patent Application No. 202010800367.7, filed on Aug. 11, 2020 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a connector with a direct locking and a rotational pre-ejection function that can be easily used for two connectors to lock, unlock, and insert into each other.

BACKGROUND OF THE DISCLOSURE

A conventional connector includes a first connector and a second connector. The first connector and the second connector can be disposed on an end of a board and an end of a wire, respectively, and the first connector and the second connector can be inserted into each other to be electrically connected. In order for the first connector and the second connector to be stably connected when being inserted into each other, a lock structure is usually disposed between the first connector and the second connector.

In the related art, triangular buckles can be disposed on the first connector and the second connector, respectively. When the first connector and the second connector are inserted into each other, two triangular buckles slide against each other and generate rotation that compresses an internal compression spring, then an elastic force of the compression spring is utilized such that the two triangular buckles automatically rotate in an opposite direction and recover to the original position, so that the two triangular buckles are locked to each other. However, when separating the first connector and the second connector from each other, the devices can only be rotated in one direction to be unlocked. If the direction of the rotation is incorrect, the devices will not be able to unlock from each other, which can cause inconvenience in use. Conventional connectors that can be unlocked in both directions already exist, and when the first connector and the second connector need to be separated, the devices can be rotated along a clockwise or counterclockwise direction to conveniently perform an unlocking operation. However, the conventional connectors do not have a pre-ejection function that allows a swift and effective separation of the two connectors.

SUMMARY OF THE DISCLOSURE

In response to the above-referenced technical inadequacies, the present disclosure provides a connector with a direct locking and a rotational pre-ejection function having a pre-ejection function, and with which two connectors can be swiftly and effectively separated from each other.

In one aspect, the present disclosure provides a connector with a direct locking and a rotational pre-ejection function. The connector includes an insulated body, a plurality of terminals, an inner shell, an outer shell, a snap ring, a plurality of fasteners, an ejector, a first elastic element, and a second elastic element. The plurality of terminals are disposed on the insulated body. The inner shell is sleeved outside of the insulated body. The outer shell is rotatably sleeved outside of the inner shell, and the outer shell has a cam surface. The snap ring is disposed between the inner shell and the outer shell for positioning the inner shell and the outer shell. The plurality of fasteners are disposed on an inner side of the outer shell, and the fasteners each have a snap body. The ejector is disposed in the outer shell, and the ejector has an ejector body, at least one ejector rod and an abutting portion. The ejector rod is connected to the ejector body, the abutting portion is disposed on the ejector body, and the abutting portion is in contact with the cam surface. The first elastic element abuts against the ejector to provide an elastic force for the ejector to recover to its original position, and the second elastic element abuts against the outer shell to provide an elastic force for the outer shell to recover to its original position. When the outer shell is rotated along a clockwise or counterclockwise direction, the outer shell can drive the cam surface to rotate, and the cam surface can push the abutting portion, so that the ejector can move in a direction towards a mating connector to eject the mating connector.

A beneficial effect of the present disclosure is that, when the connector of the present disclosure and the mating connector are to be separated from each other, the outer shell can be rotated along the clockwise or counterclockwise direction, so that the snap bodies of the fasteners and fastener bodies of the mating connector can be separated from each other to achieve the unlocking effect. When the outer shell is rotated along the clockwise or counterclockwise direction, the outer shell can drive the cam surface to push the abutting portion of the ejector, so that the ejector can move forward and eject the mating connector with the pre-ejection function, which allows a swift and effective separation of two connectors.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
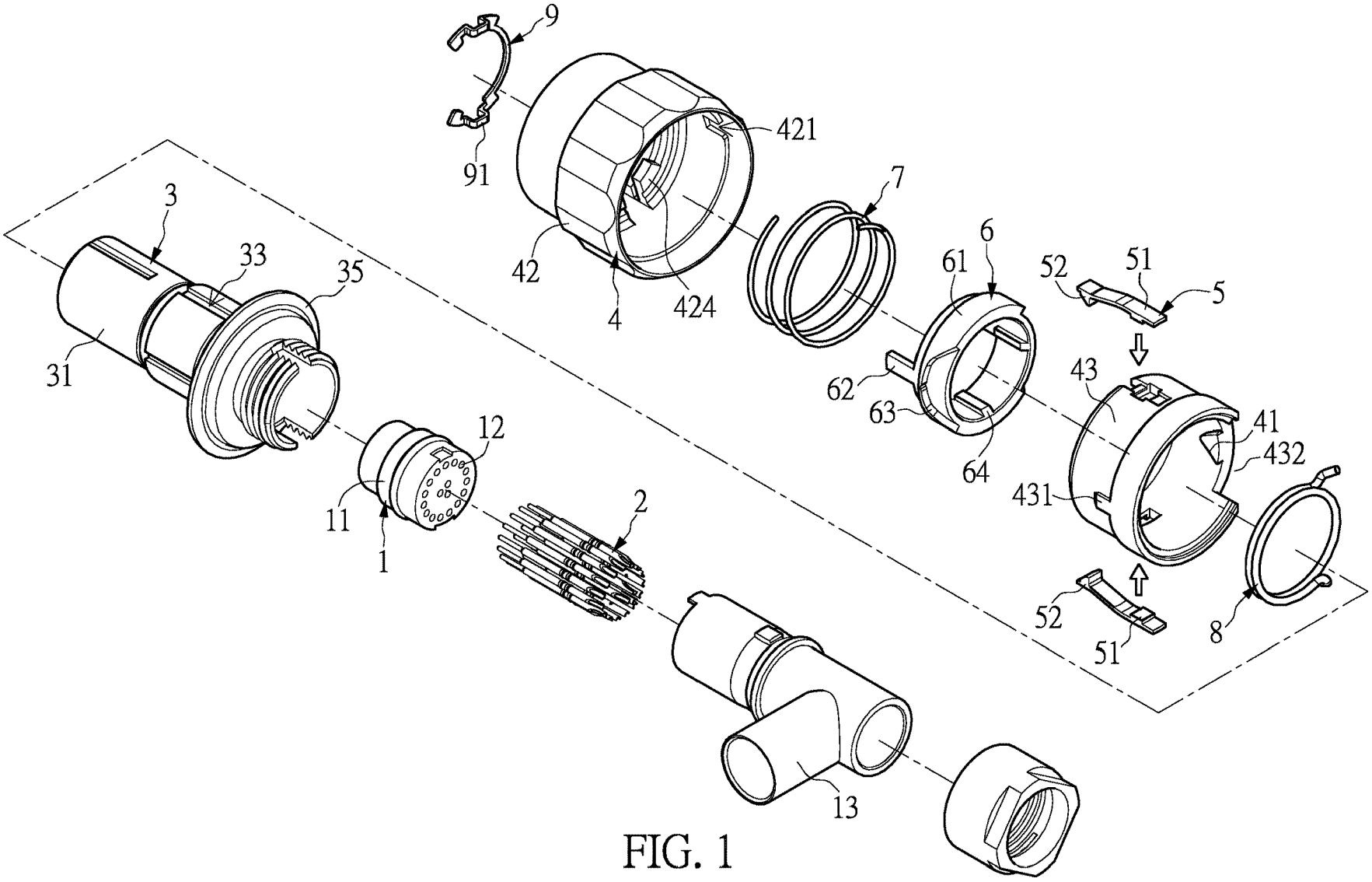
FIG. 1 is a perspective exploded view of a connector of the present disclosure.
Figure 2:
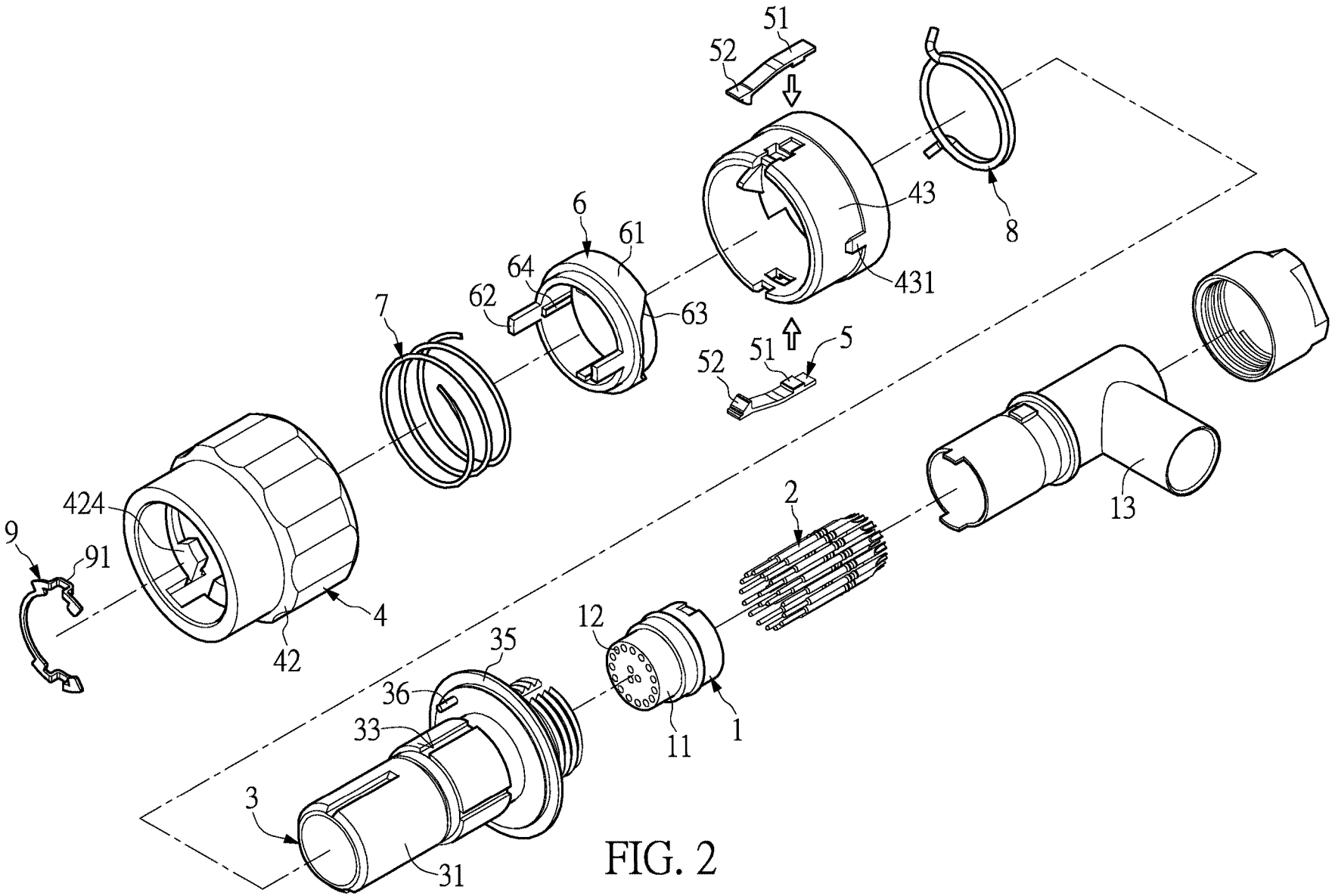
FIG. 2 is another perspective exploded view of the connector of the present disclosure.
Figure 3:
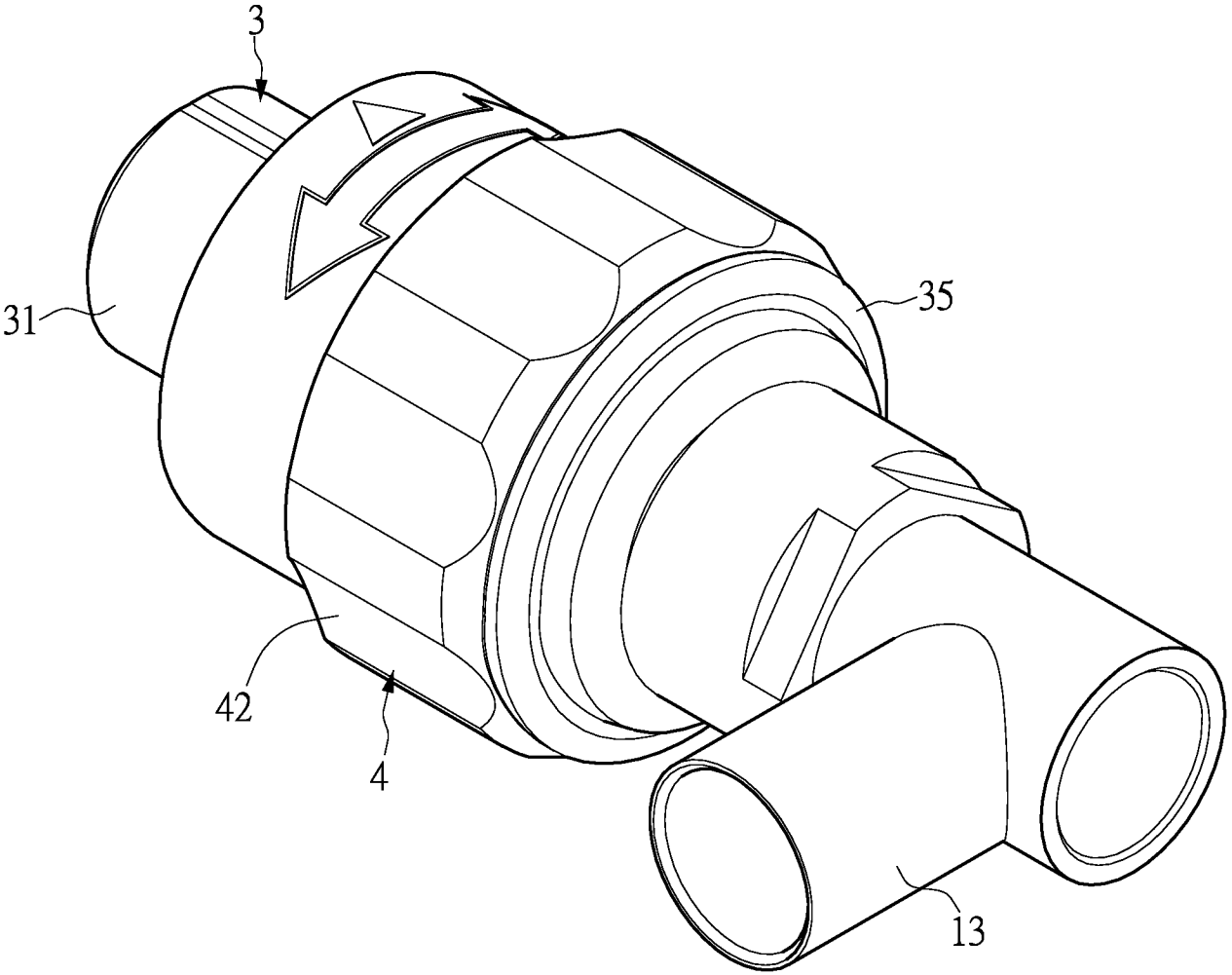
FIG. 3 is a perspective view of the connector of the present disclosure.
Figure 4:
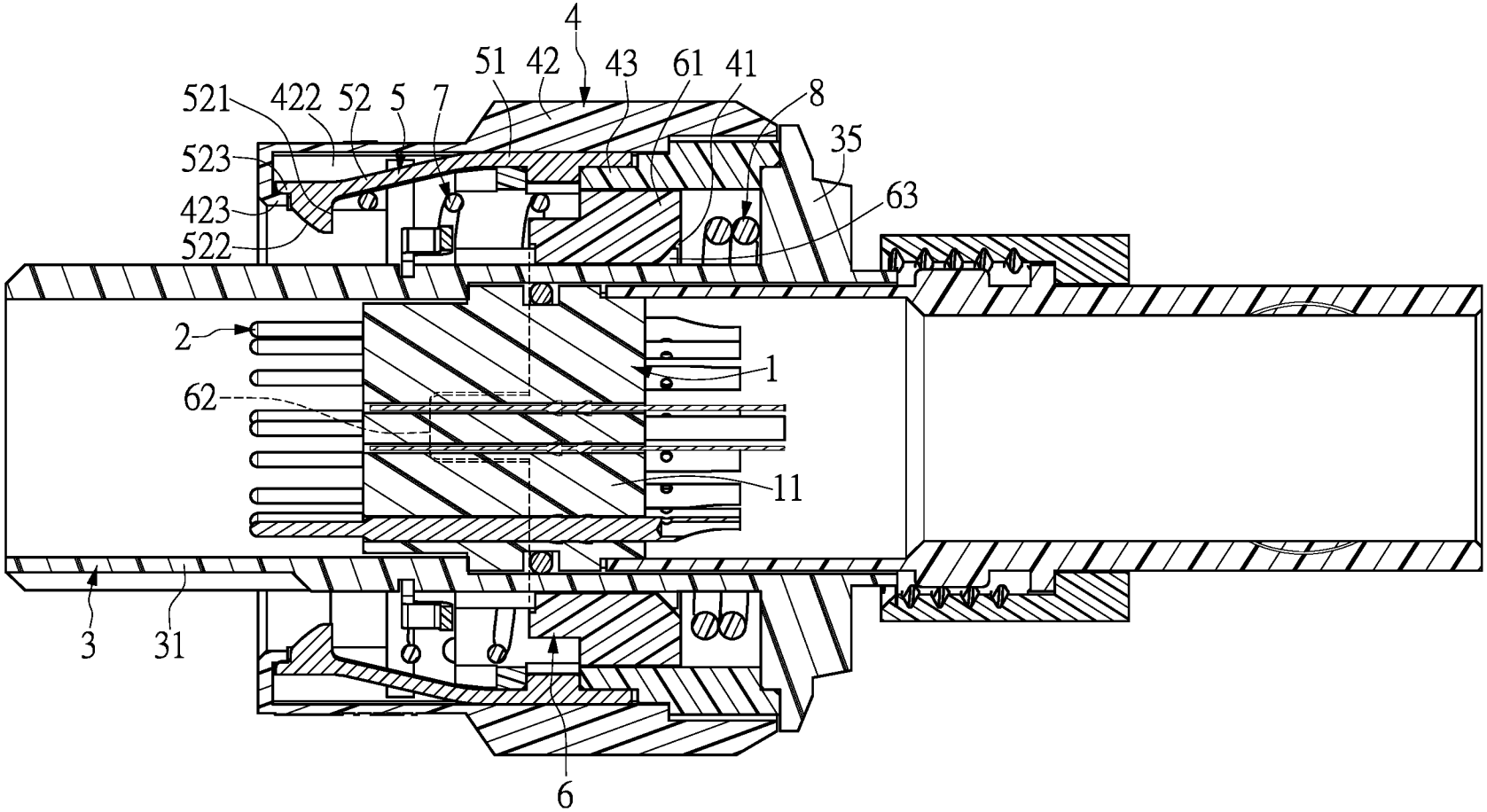
FIG. 4 is a cross-sectional view of the connector of the present disclosure.
Figure 5:
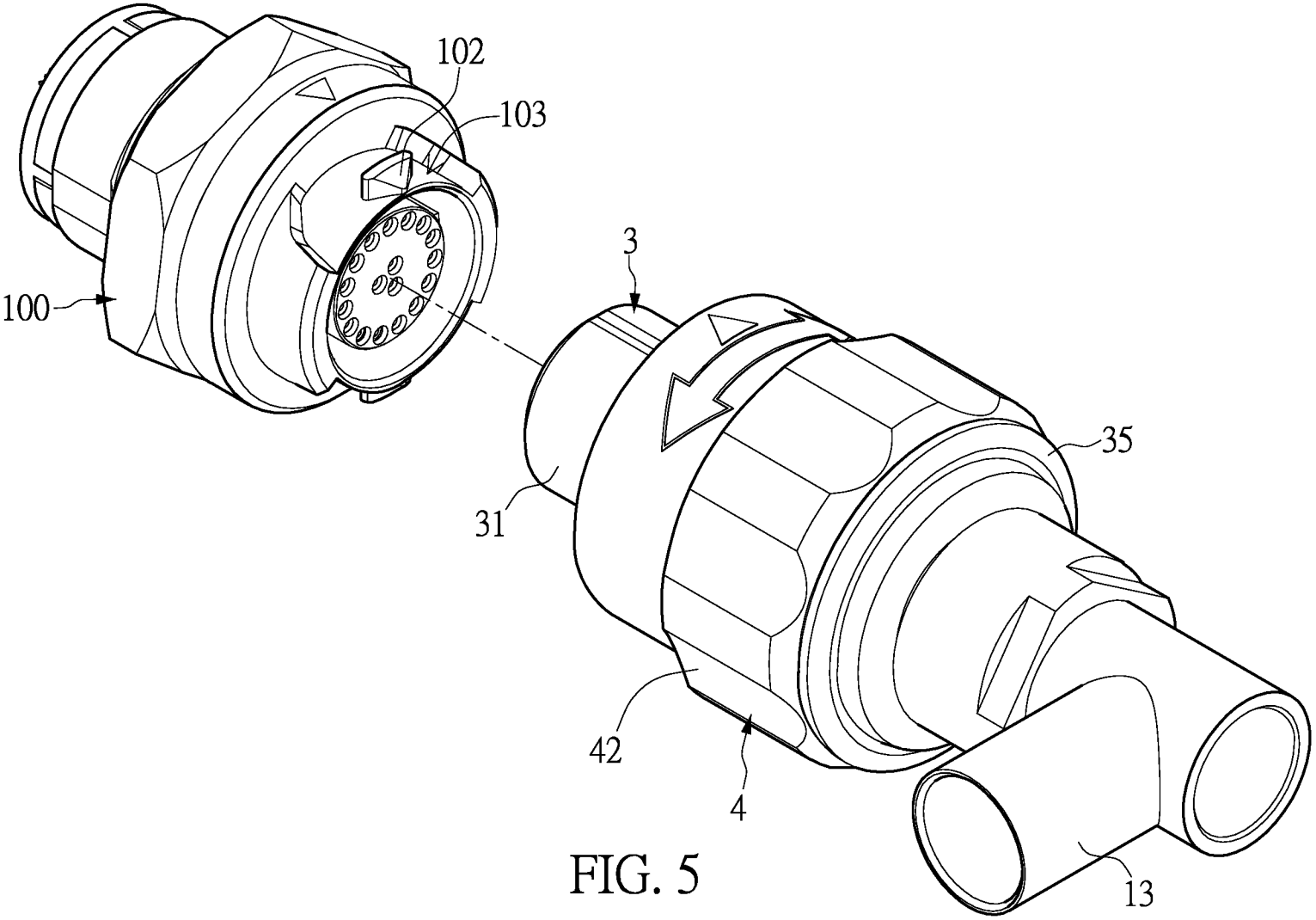
FIG. 5 is a perspective view of the connector and a mating connector in a separated state of the present disclosure.
Figure 6:
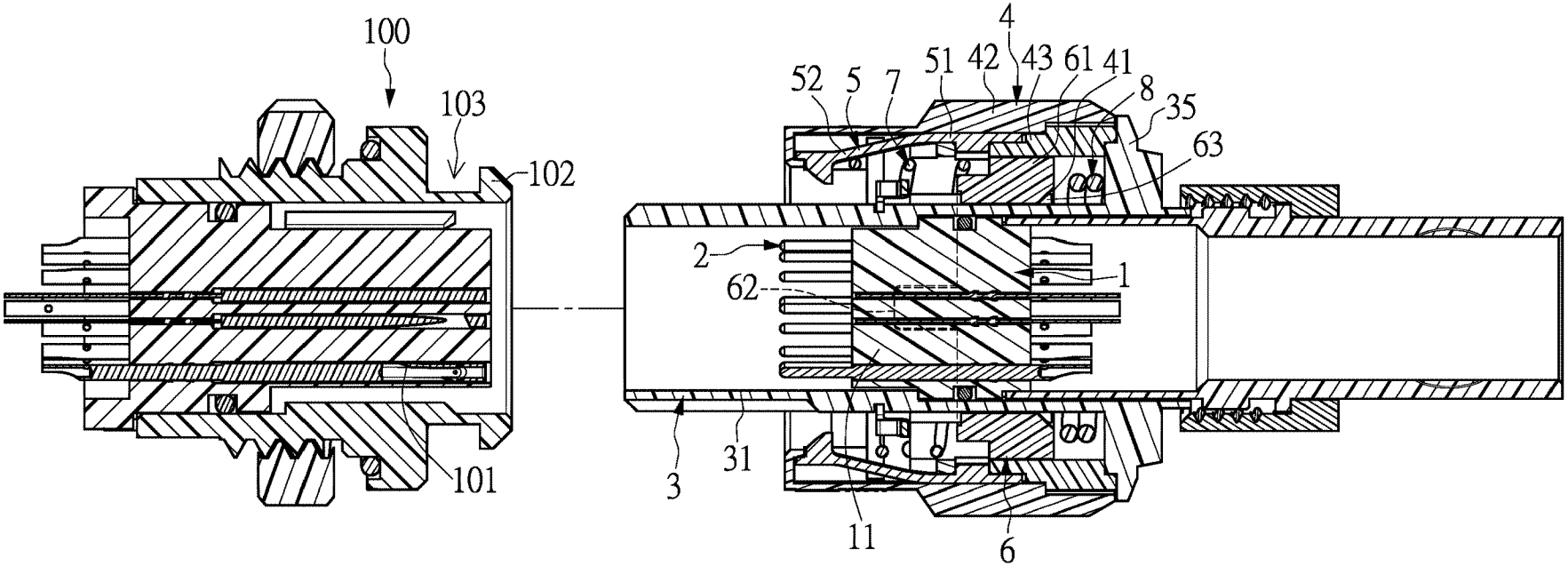
FIG. 6 is a cross-sectional view of the connector and the mating connector in the separated state of the present disclosure.
Figure 7:
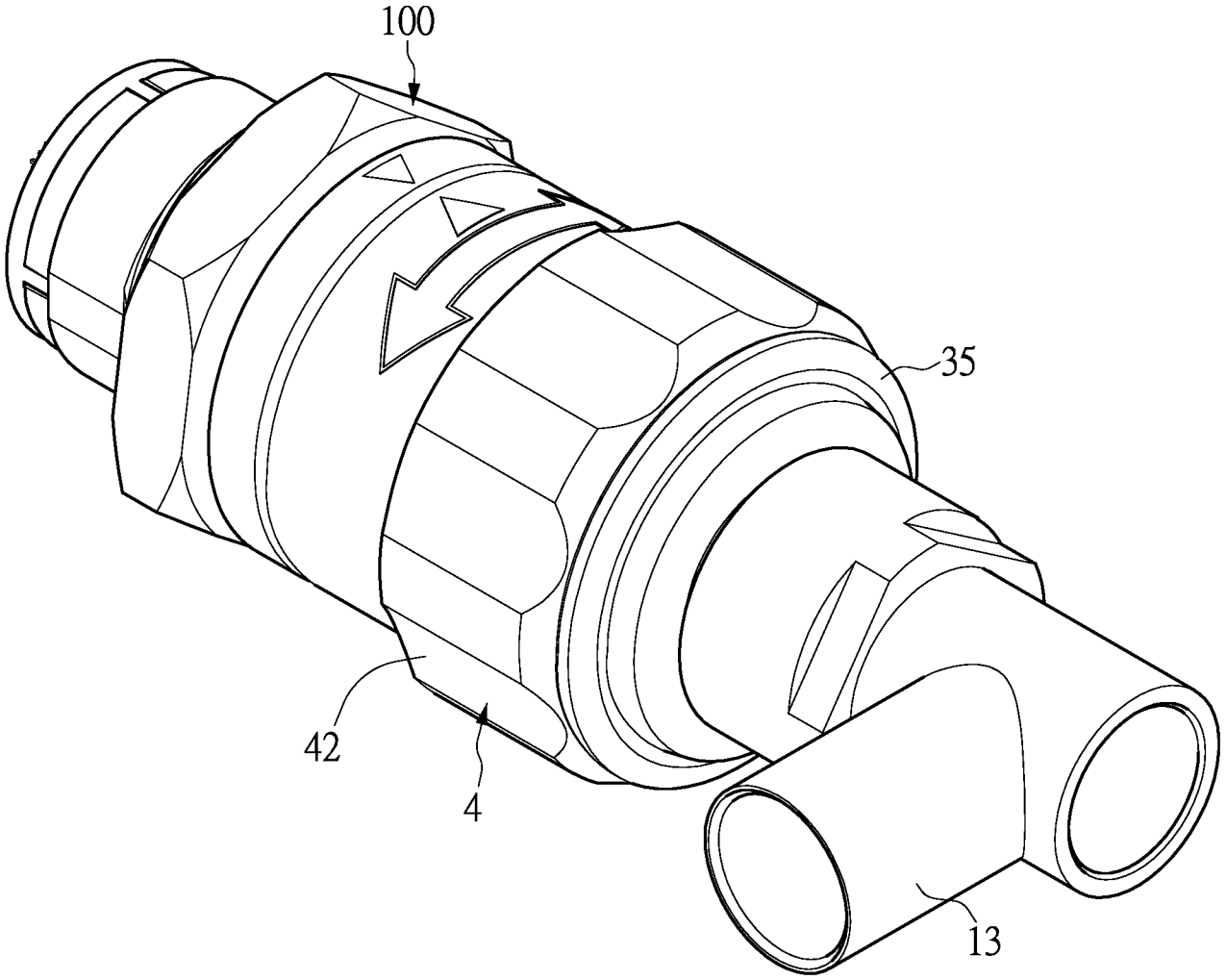
FIG. 7 is a perspective view of the connector and the mating connector in an inserted state of the present disclosure.
Figure 8:
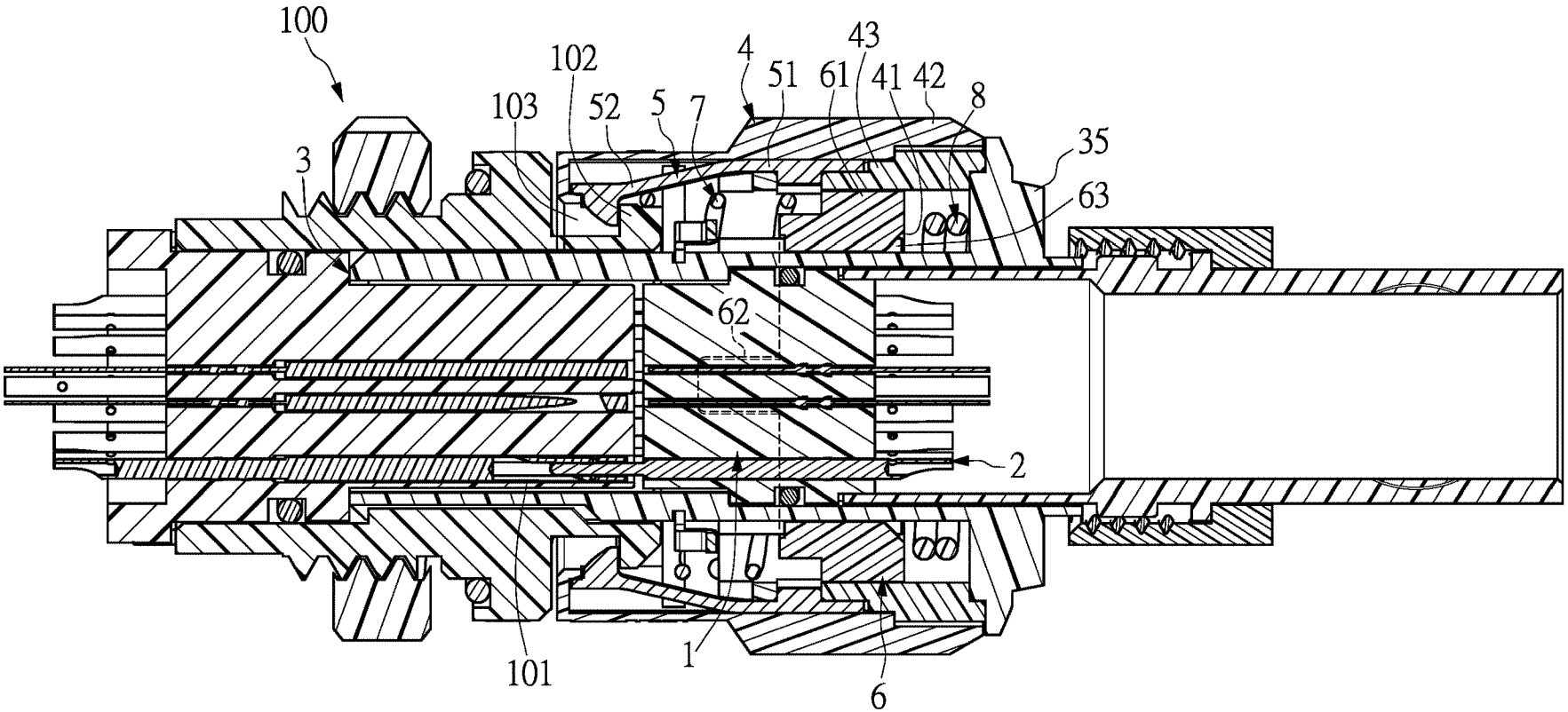
FIG. 8 is a cross-sectional view of the connector and the mating connector in the inserted state of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 4, the present disclosure provides a connector with a direct locking and a rotational pre-ejection function. The connector includes an insulated body 1, a plurality of terminals 2, an inner shell 3, an outer shell 4, a snap ring 9, a plurality of fasteners 5, an ejector 6, a first elastic element 7 and a second elastic element 8.

A "front end" described in each component of the present disclosure refers to an end that is close to a mating connector, and a "rear end" refers to an end that is away from the mating connector. That is, an end that faces in an insertion is defined as the "front end", and an end that faces away from the insertion is defined as the "rear end".

The insulated body 1 is made of plastic material, which is an insulator. The insulated body 1 can have a body portion 11 and a plurality of terminal holes 12. The body portion 11 can be cylindrical. The terminal holes 12 are disposed on the body portion 11, and the terminal holes 12 penetrate through two ends (front end and rear end) of the body portion 11, so as to have the terminals 2 assembled thereto.

The terminals 2 are made of conductive metal materials, and the terminals 2 are disposed on the insulated body 1. The terminals 2 can be used as power terminals, signal powers, etc. The terminals 2 are assembled to the terminal holes 12, respectively, so that the terminals 2 are disposed on the insulated body 1. Rear ends of the terminals 2 can extend through a rear end of the insulated body 1, so as to be electrically connected to cables and other devices. A rear end of the body portion 11 of the insulated body 1 can also be further connected to a casing 13 for cables to pass through.

The inner shell 3 is made of metal materials. The inner shell 3 can have an inner shell body 31 and a stop ring 35, the inner shell body 31 has a hollow body, and the inner shell body 31 can be cylindrical. The inner shell 3 is sleeved outside of the insulated body 1, the stop ring 35 is fixed on an outer side of the inner shell body 31, and the stop ring 35 protrudes from the outer side of the inner shell body 31. The stop ring 35 is near a rear end of the inner shell body 31.

The outer shell 4 is made of metal materials. The outer shell 4 has a hollow body, and the outer shell 4 can be cylindrical. The outer shell 4 has a cam surface 41 and at least one protruding block 424. In the present embodiment, the outer shell 4 can be a two-piece design, and molding is relatively simple. The outer shell 4 includes an outer cylinder body 42 and a cam member 43, and the cam surface 41 is disposed on an inner side of the cam member 43. The protruding block 424 is disposed on an inner side of the outer cylinder body 42, and the outer cylinder body 42 is sleeved outside of the cam member 43. The outer cylinder body 42 and the cam member 43 can be properly snapped and fixed in between each other. That is, a card slot 421 can be disposed in the inner side of the outer cylinder body 42, and a card indentation 431 can be disposed on an outer side of the cam member 43. The card slot 421 and the card indentation 431 can be snapped and fixed to each other, so that the outer cylinder body 42 and the cam member 43 can be assembled together. In another embodiment, the outer cylinder body 42 and the cam member 43 can also adopt a one-piece design, so that the cam surface 41 can be directly formed on an inner side of the outer shell 4. The outer shell 4 is rotatably sleeved outside of the inner shell 3, so that the outer shell 4 can be rotated along a clockwise or counterclockwise direction outside of the inner shell 3.

The snap ring 9 can be board-shaped, and the snap ring 9 has at least one flange 91. The snap ring 9 is fixed on an outer side of the inner shell 3, and the flange 91 of the snap ring 9 is disposed between two protruding blocks 424 of the outer shell 4 to fix (position) the outer shell 4 and the inner shell 3.

The fasteners 5 can each have a fastener main body 51 and a snap body 52. The snap body 52 is connected to the fastener main body 51, and the fastener main body 51 has elastic arms. The fastener main bodies 51 of the fasteners 5 can be fixed on an inner side of the outer shell 4, so that the fasteners 5 are disposed on the inner side of the outer shell 4. In the present embodiment, a plurality of accommodating slots 422 are disposed on the outer cylinder body 42, and the accommodating slots 422 correspond to the snap bodies 52, respectively, so that the snap bodies 52 can move elastically.

Preferably, a snap surface 521 is formed on the snap bodies 52, and the snap surface 521 can be perpendicular to an axial direction (an insertion direction) of the connector, so that the snap bodies 52 have a greater snapping effect. A guide surface 522 can be formed on the snap bodies 52, and the guide surface 522 can be an inclined surface or an arc surface that is used to guide the snap bodies 52 to successfully snap with the mating connector. A bump 523 can be disposed at an end of the snap bodies 52 away from the fastener main body 51, and an inner side of the outer cylinder body 42 has a stop block 423. When the snap bodies 52 move inward, the bumps 523 can be positioned to abut against the stop block 423, so as to limit a moving angle of the snap bodies 52. Further, when the bumps 523 contact (impact) the stop block 423, an alerting sound can be generated.

The ejector 6 is disposed in the outer shell 4, the ejector 6 can be disposed in the cam member 43 of the outer shell 4, and the ejector 6 can also be disposed outside of the inner shell 3, so that the ejector 6 is positioned between the inner shell 3 and the outer shell 4. The ejector 6 has an ejector body 61, at least one ejector rod 62 and an abutting portion 63. The ejector body 61 can be ring-shaped, a plurality of the ejector rods 62 are disposed on the ejector body 61, and the ejector rods 62 are disposed at intervals. The ejector rods 62 are connected to the ejector body 61, and can be connected to an end (front end) of the ejector body 61. The ejector rods 62 extend in a forward direction, i.e., extending in the insertion direction. The abutting portion 63 is disposed on the ejector body 61, and the abutting portion 63 can be disposed on the ejector body 61 and near another end (rear end) of the ejector body 61. The abutting portion 63 can be a cam surface, and the abutting portion 63 contacts the cam surface 41.

In the present embodiment, an inner side of the ejector body 61 has a plurality of guide blocks 64, and an inner side of the inner shell body 31 has a plurality of guide grooves 33. The guide grooves 33 can extend along the insertion direction of the connector, and the guide blocks 64 can slidably cooperate with the guide grooves 33 so as to guide the ejector 6 to stably move forward and backward. When the outer shell 4 is rotated along the clockwise or counterclockwise direction, the outer shell 4 can drive the cam surface 41 to rotate, and the cam surface 41 can push the abutting portion 63 of the ejector 6, so that the ejector 6 can move forward. That is, the ejector 6 can move towards the mating connector, so as to eject the mating connector through the pre-ejection function. In the present embodiment, the ejector rods 62 and the snap bodies 52 are each two in number, and are arranged at staggered positions.

The first elastic element 7 abuts against the ejector 6 to provide an elastic force for the ejector 6 to recover to its original position, and the first elastic element 7 can be a compression spring. The first elastic element 7 can be disposed between the inner shell 3 and the outer shell 4, one end of the first elastic element 7 can abut against the protruding blocks 424 of the outer shell 4, and another end of the first elastic element 7 can abut against the ejector body 61, so that the first elastic element 7 can push the ejector 6 to move backward and recover.

Figure 9:
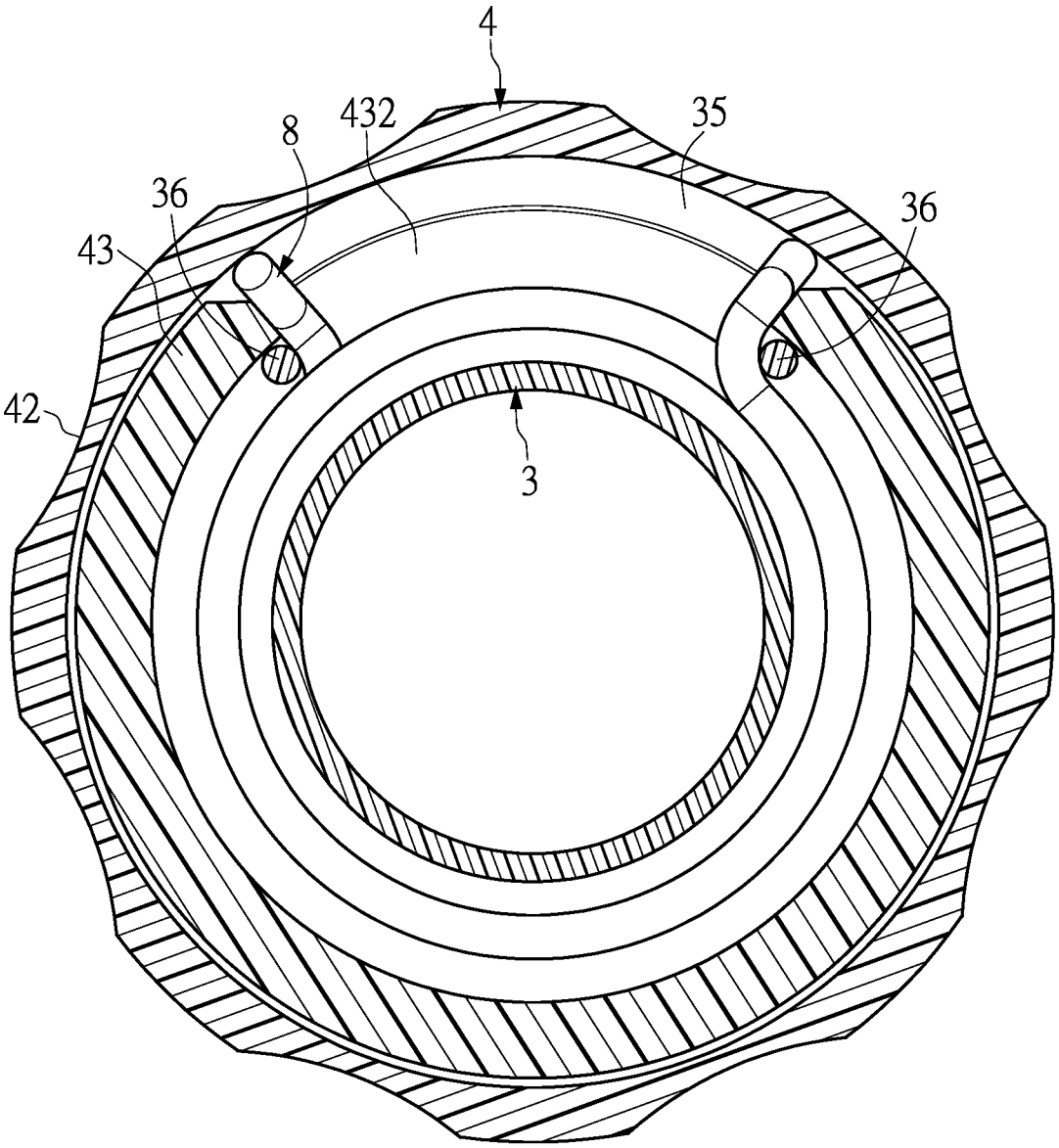
FIG. 9 is a schematic view of an operation of a second elastic element of the present disclosure.

The second elastic element 8 abuts against the outer shell 4 to provide an elastic force for the outer shell 4 to rotate and recover with, and the second elastic element 8 can be a torsion spring. The second elastic element 8 can be disposed between the inner shell 3 and the outer shell 4, one end of the second elastic element 8 can abut against the inner shell 3 and the outer shell 4 (as shown in FIG. 9), and another end of the second elastic element 8 can abut against the inner shell 3 and the outer shell 4, so that the second elastic element 8 can push the outer shell 4 to rotate and recover. In the present embodiment, a notch 432 can be disposed on the cam member 43 of the outer shell 4, and two protrusions 36 are disposed on the stop ring 35 of the inner shell 3. One end of the second elastic element 8 can abut against one protrusion 36 and one end of the notch 432, another end of the second elastic element 8 can abut against another protrusion 36 and another end of the notch 432 for the outer shell 4 to rotate and recover.

In the present embodiment, the ejector 6, the first elastic element 7 and the second elastic element 8 can be inserted between the inner shell 3 and the outer shell 4 from front to back, and the stop ring 35 of the inner shell 3 is disposed at a rear end of the outer shell 4 to close off the rear end of the outer shell 4, so that the ejector 6, the first elastic element 7, the second elastic element 8, etc. can be positioned between the inner shell 3 and the outer shell 4.

Referring to FIG. 5 to FIG. 8, a connector of the present disclosure that can be inserted into a mating connector 100 is shown. The mating connector 100 has a plurality of mating terminals 101 and a plurality of fastener bodies 102, and a groove 103 is disposed on an outer side of the fastener bodies 102. When the connector of the present disclosure and the mating connector 100 are inserted into each other, the snap bodies 52 can slide outward past the fastener bodies 102, so that the snap bodies 52 are snapped into a rear end of the fastener bodies 102 to achieve a direct locking effect. At this time, the snap bodies 52 are located at the groove 103 at a back side of the fastener bodies 102, and the terminals 2 and the mating terminals 101 are in contact and electrically connected to each other.

When the connector of the present disclosure and the mating connector 100 are to be separated from each other, the outer shell 4 can be rotated along the clockwise or counterclockwise direction. The snap bodies 52 can slide to a position near a side (left side or right side) of the groove 103, so that the snap bodies 52 are separated from the fastener bodies 102 to achieve an unlocking effect. When the outer shell 4 of the present disclosure rotates along the clockwise or counterclockwise direction, the snap bodies 52 can each exit outward through the groove 103 and separate from the fastener bodies 102 to achieve a bi-directional unlocking effect.

When the connector of the present disclosure and the mating connector 100 are to be separated from each other, the outer shell 4 can be rotated along the clockwise or counterclockwise direction. The outer shell 4 can drive the cam surface 41 to rotate, and the cam surface 41 can push the abutting portion 63 of the ejector 6, so that the ejector 6 can move forward to use the ejector rods 62 to eject the mating connector 100 through the pre-ejection function.

A beneficial effect of the present disclosure is that, when the connector of the present disclosure and the mating connector are to be separated from each other, the outer shell can be rotated along the clockwise or counterclockwise direction, so that the snap bodies of the fastener and the fastener bodies of the mating connector can be separated from each other to achieve the unlocking effect, in which the connector of the present disclosure can be unlocked in the bi-directional directions, to conveniently perform an unlocking operation. Furthermore, when the outer shell is rotated along the clockwise or counterclockwise direction, the outer shell can drive the cam surface to push the abutting portion of the ejector, and the ejector can move in a forward direction to eject the mating connector through the pre-ejection function, so as to allow a swift and effective separation of the two connectors.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connector with a direct locking and a rotational pre-ejection function, comprising:

an insulated body;

a plurality of terminals, the terminals being disposed on the insulated body;

an inner shell, the inner shell being sleeved outside of the insulated body;

an outer shell, the outer shell being rotatably sleeved outside of the inner shell, and the outer shell having a cam surface;

a snap ring, the snap ring being disposed between the inner shell and the outer shell for positioning the inner shell and the outer shell;

a plurality of fasteners, the fasteners being disposed on an inner side of the outer shell, and each having a snap body;

an ejector, the ejector being disposed in the outer shell, the ejector having an ejector body, at least one ejector rod, an abutting portion and at least one guide block, the at least one ejector rod being connected to the ejector body, the abutting portion being disposed on the ejector body, the abutting portion being in contact with the cam surface, and the guide block being disposed on an inner side of the ejector body;

a first elastic element, the first elastic element abutting against the ejector to provide an elastic force that allows the ejector to recover; and a second elastic element, the second elastic element abutting against the outer shell to provide an elastic force that allows the outer shell to recover;

wherein when the outer shell is rotated along a clockwise or counterclockwise direction, the outer shell drives the cam surface to rotate, and the cam surface pushes the abutting portion, so that the ejector moves in a direction toward a mating connector to eject the mating connector.

2. The connector according to claim 1, wherein the inner shell has an inner shell body, a stop ring, two protrusions and a guide groove, the stop ring being disposed on an outer side of the inner shell body, and the stop ring being disposed at a rear end of the inner shell body, and wherein the two protrusions are disposed on the stop ring, the guide groove being disposed on an outer side of the inner shell body, and the guide block slidably cooperating with the guide groove.

3. The connector according to claim 1, wherein the outer shell includes an outer cylinder body and a cam member, the cam surface being disposed on an inner side of the cam member, and wherein a rear end of the cam member has a notch, the outer cylinder body being sleeved outside of the cam member, and the outer cylinder body and the cam member being fixed therebetween.

4. The connector according to claim 1, wherein the snap ring has at least one flange, the snap ring being fixed on an outer side of the inner shell, the outer shell having two protruding bumps, and the flange being disposed between the two protruding bumps of the outer shell.

5. The connector according to claim 1, wherein the fastener has a fastener main body, the snap body is connected to the fastener main body, the fastener has elastic arms, and the outer shell includes an outer cylinder body and a cam member, wherein the cam surface is disposed on an inner side of the cam member, and the fastener main body of the fastener is fixed between the outer cylinder body and the cam member of the outer shell, and wherein a plurality of accommodating slots are disposed on the outer cylinder body, and the accommodating slots correspond to the snap bodies, respectively.

6. The connector according to claim 5, wherein a snap surface and a guide surface are formed on the snap bodies, and a bump is disposed at an end of the snap bodies that is away from the fastener main body, and wherein the inner side of the outer cylinder body has a stop block, and when the snap bodies move inward, the bumps are positioned to abut against the stop block.

7. The connector according to claim 5, wherein the ejector is disposed in the cam member of the outer shell, and the ejector is disposed outside of the inner shell, so that the ejector is positioned between the inner shell and the outer shell.

8. The connector according to claim 1, wherein the first elastic element is a compression spring, the first elastic element being disposed between the inner shell and the outer shell, and wherein an end of the first elastic element abuts against the outer shell, and another end of the first elastic element abuts against the ejector body.

9. The connector according to claim 1, wherein the second elastic element is a torsion spring, the second elastic element is disposed between the inner shell and the outer shell, and the inner shell has two protrusions, wherein the outer shell has a cam member, the cam surface is disposed on an inner side of the cam member, and a rear end of the cam member has a notch, and wherein an end of the second elastic element abuts against a protrusion of the inner shell and an end of the notch of the cam member of the outer shell, and another end of the second elastic element abuts against another protrusion of the inner shell and another end of the notch of the cam member of the outer shell.

10. The connector according to claim 1, wherein the ejector body is ring-shaped, a plurality of the ejector rods are disposed thereon, and the ejector rods are disposed at intervals.

11. The connector according to claim 10, wherein the ejector rods are connected to an end of the ejector body, and the abutting portion is disposed on the ejector body and near another end of the ejector body.

12. The connector according to claim 1, wherein the ejector rods and the snap bodies are arranged in staggered positions.

* * * * *